United States Patent [19]

Toshimasa et al.

[11] Patent Number: 4,534,164

[45] Date of Patent: Aug. 13, 1985

[54] TEXTURED YARN AND METHOD AND APPARATUS FOR PRODUCING THE SAME

[75] Inventors: Kuroda Toshimasa, Takatsuki; Kimura Akio, Ashiya; Horiuchi Takumi; Sasaki Koki, both of Matsuyama; Ikuta Terukuni, Takatsuki, all of Japan

[73] Assignee: Teijin Limited, Osaka, Japan

[21] Appl. No.: 473,950

[22] Filed: Mar. 10, 1983

[30] Foreign Application Priority Data

| | | | |
|---|---|---|---|
| Mar. 16, 1982 | [JP] | Japan | 57-40304 |
| Mar. 17, 1982 | [JP] | Japan | 57-40705 |
| Mar. 18, 1982 | [JP] | Japan | 57-41737 |

[51] Int. Cl.[3] ..... D02G 1/02; D01H 13/28

[52] U.S. Cl. ..... 57/290; 57/282; 57/284

[58] Field of Search ..... 57/204, 205, 206–208, 57/282–286, 290–292, 293, 295, 296, 308, 350, 351, 908

[56] References Cited

U.S. PATENT DOCUMENTS

| | | | |
|---|---|---|---|
| 3,085,389 | 4/1963 | Wegener et al. | 57/286 |
| 3,473,317 | 10/1969 | Kosaka et al. | 57/290 X |
| 3,796,036 | 3/1974 | Parker | 57/290 X |
| 3,910,027 | 10/1975 | Bach et al. | 57/290 X |
| 4,086,751 | 5/1978 | Hino et al. | 57/290 X |
| 4,115,985 | 9/1978 | Venot | 57/290 X |
| 4,141,206 | 2/1979 | Eaves | 57/290 |
| 4,332,132 | 6/1982 | Bru et al. | 57/291 X |
| 4,398,386 | 8/1983 | Endo et al. | 57/290 X |

*Primary Examiner*—Donald Watkins

*Attorney, Agent, or Firm*—Burgess, Ryan & Wayne

[57] ABSTRACT

A textured yarn suitable for weaving a fabric having an improved width shrinkage is provided by a simultaneous draw-texturing process of a partially oriented polyethylene terephthalate (PET) filament. During the draw-texturing process, the yarn delivered from a main heater is adjusted to maintain a yarn temperature not less than 80° C. which corresponds to a glass transition temperature of PET prior to being introduced into a false twister, whereby both the crimpability and sonic velocity of the resulting yarn are improved. A fabric woven therefrom has a good bulkiness as well as a good resiliency. Further, according to the same principal, a textured yarn having crimp unevenness suitable for producing a fabric having a surface contour is provided by varying the yarn temperature prior to being introduced into the false twister in a range between 80° C. and 160° C. The latter yarn has no tight spots therein and results in a natural looking fabric.

12 Claims, 8 Drawing Figures

TEXTURED YARN AND METHOD AND APPARATUS FOR PRODUCING THE SAME

BACKGROUND OF THE INVENTION

1. Field of the Invention

The present invention relates to a textured yarn of polyester filaments obtained by a simultaneous draw-texturing process. More specifically, it relates to a false-twist textured yarn suitable for a woven fabric, having properties defined by specific ranges of crimpability and sonic velocity.

2. Description of the Prior Art

False-twist texturing is suitable for processing synthetic filament yarn because it can produce various types of textured yarns by just adjusting the yarn tension, heater temperature, and other process conditions. In fact, more than 70% of all polyester filament yarns supplied to the market of clothing is in the form of false-twist textured yarn.

The false-twist texturing basically comprises heat-setting a twisted thermoplastic yarn to a plastic condition; cooling the same below a glass transition temperature thereof to fix the spiral form of the twisted yarn; and untwisting the same through a false twister. Of these steps, cooling has been believed the most essential for good textured yarn.

Therefore, all conventional false-twist texturing machines are constructed with a long cooling zone between the heater and false twister. Yarn heated by the heater is forced to pass through the cooling zone, preferably a cooling plate, for at least 0.16 second. The mechanism of cooling is described in detail in "Manual of Filament Processing Technique", vol. 1, p. 90 to 93, published by the Textile Machinery Society of Japan.

A recent trend in flase-twist texturing has been for the use of the so-called POY-DTY system. A partially-oriented yarn (POY), of polyester spun at a rate from 2,500 to 3,500 m/min is processed by a draw-texturing machine (DTY machine) in which the yarn is false-twisted simultaneously with drawing at a higher rate than that of the conventional process applied to a full drawn yarn. The processing rate of the conventional process is usually lower than 150 m/min; while that of the DTY process is more than 500 m/min.

Since DTY machines available nowadays are still constructed in accordance with the above-mentioned conventional principle, they have to have a longer cooling zone corresponding to the higher processing rate so as to ensure an equivalent cooling time as the former conventional machines.

On another matter, one of the important functions required for false-twist textured yarn is a higher width shrinkage of a grey fabric made thereof in a relaxation process. This shrinkage gives the finished fabric a good feel. Width shrinkage has been believed to rely mainly on crimpability of the textured yarn.

The present inventors made various attempts to produce textured yarn fabrics having an improved hand regarding both bulkiness and resiliency by means of the conventional POY-DTY system. However, they failed to obtain the desired fabric. Through their attempts, however, the present inventors found that a cause of their failure was attributed to the yarn cooling mode. According to the conventional understanding, the yarn temperature before introduction to a false twister (pre-twister temperature) had to be below the glass transition temperature (Tg) and, if the temperature were higher than Tg, the spiral form of the yarn would be deformed so that the crimpability of the textured yarn would decrease.

SUMMARY OF THE INVENTION

Thus, it is an object of the present invention to provide a high quality false-twist textured yarn having a latent crimpability which realizes an improved width shrinkage of a grey fabric made of such yarn.

It is another object of the present invention to provide a unique false-twist textured yarn having unevenness of the crimp in the longitudinal direction thereof.

It is still another object of the present invention to provide methods and apparatus suitable for effectively producing the above yarns.

The aforementioned objects are accomplished by modifying the physical properties of the yarn so that the velocity of sound in the yarn is increased. This modification is accomplished by raising the yarn temperature above its glass transition point before the yarn is fed to a false twister.

According to one aspect of the invention a method is provided for producing textured polyester yarn by raising its temperature above the glass transition point prior to false twisting.

According to another aspect of the invention, a textured polyester yarn is provided having specified crimpability and sonic velocity characteristics.

According to still another aspect of the invention, a textured polyester yarn is provided having specified numbers and sizes of crimps and specified latent torque characteristics.

According to a further aspect of the invention, there is provided a false-twist yarn texturing machine having an additional heater just before the false twister.

According to a still further aspect of the invention, there is provided a false-twist yarn texturing machine having a pivotably mounted main heater.

BRIEF DESCRIPTION OF THE DRAWINGS

The above-mentioned invention will now be described more specifically in reference to the accompanying drawings, in which.

DESCRIPTION OF THE PREFERRED EMBODIMENTS

[First Aspect]

Figure 1:
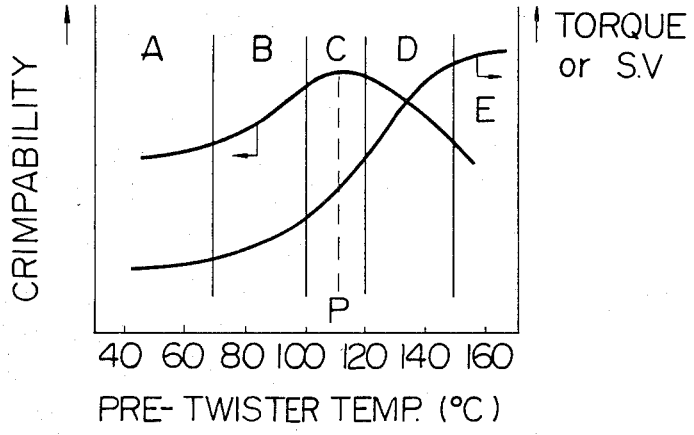
FIG. 1 is a graph of relations of the pre-twister temperature of the yarn to be processed in a texturing process to crimpability and the torque or a sonic velocity of the textured yarn.

According to one aspect of the invention, there is provided a false-twist textured yarn obtained by draw texturing a polyester filament yarn by a friction type false twister having a twisting function as well as a yarn driving function. The textured yarn is characterized by the following properties;

(a) $35-0.08\ De \leqq TC\ (\%) \leqq 44-0.08\ De$ (b) SV≧2.50 (km/sec)

where TC is the crimpability, De is the total denier of a textured yarn, and SV is the sonic velocity in the textured yarn under a tension of 0.3 g/De.

As described above, in the present invention, the sonic velocity in the textured yarn and the crimpability, i.e., SV and TC, are essential factors to impart good bulkiness and resiliency to the woven fabric.

The values of SV and TC defined above can be obtained only by means of the POY-DTY system and cannot be attained by the conventional process applied to full drawn yarn.

In order to obtain a woven fabric having a good hand regarding both bulkiness and resiliency, it is important that the textured yarn has a TC within a predetermined range and above a certain level of SV.

As is well known, after weaving, a grey fabric of the textured yarn is subjected to relaxation, preset, dyeing, and final set. Of these, relaxation is most essential for determining the quality of the fabric. In relaxation, the fabric is treated under a non-restrained condition in hot water of approximately 95° C. to 97° C. for several dozen seconds, whereby the fabric shrinks in width and, on the contrary, increases in thickness. This process, basically determines the hand of the final fabric. Prior to the present invention, it was thought that the crimpability of the textured yarn is the only effective factor of the width shrinkage. The present inventors, however, have discovered that not only the TC but also the SV is effective on shrinkage.

This discovery is novel information no one noticed in this field prior to the present invention.

The textured yarn of the present invention is obtainable only by a novel process hereinafter described. It is impossible to keep both the two factors in a suitable range according to the conventional texturing process.

One feature of the textured yarn according to the present invention is a range of TC defined by the following equation (1):

$$35-0.08\times De \geqq TC\ (\%) \geqq 44-0.08\times De \ldots (1).$$

The TC is measured as follows: as a test piece, a textured yarn is wound in the form of a hank having a total denier of approximately 1500. The hank is treated in boiling water for 20 minutes under tension caused by a hanging weight of 2 mg/De. The hank is dried freely under room conditions of 20° C. and 65% RH for 24 hours. After being loaded by a weight of 200 mg/De for one minute, a hank length $l_0$ is measured. Thereafter, the weight is replaced by a lighter weight of 2 mg/De. One minute later, the length $l_1$ is measured. From the $l_0$ and $l_1$, TC is calculated by the following equation (2), $$TC\ (\%) = \frac{l_0 - l_1}{l_0} \times 100. \quad (2)$$

Naturally, the desirable TC value varies depending on the yarn thickness (total denier). However, as shown in the equation (1), it should be more than $35-0.08\times De$ to impart good bulkiness to the woven fabric and should be less than $44-0.08\times De$ not to decrease the resiliency of the woven fabric.

SV must be more than 2.50 km/sec. If not, even if the TC is kept in a suitable range, the shrinkage of the grey fabric becomes insufficient, which results in poor resiliency of the finished fabric. Contrary to this, if the SV is large enough, but the TC is less than the lower limit, the finished fabric is poor in appearance and bulkiness due to excessive creping, even though the shrinkage is large. Accordingly, to obtain a good feel textured yarn fabric, it is important that the TC and the SV be simultaneously within the above limitations.

Such textured yarn can be obtained by using a POY of polyester filament as a starting material and also by controlling the pre-twister temperature to a higher level relative to the conventional DTY process and, further by false-twist the yarn with a number of twist defined by a specific range of a twist coefficient $\alpha$. A more detailed explanation is made below.

The polyester POY utilized in the present invention is mainly composed of polyethylene terephthalate having a birefringence $\Delta n$ of less than 0.09. If the $\Delta n$ exceeds 0.09, fluff and yarn breakage may occur during the DTY process, especially in high speed processing. The most preferable range of the $\Delta n$ is from 0.03 to 0.05. If the $\Delta n$ is less than 0.03, the draw ratio has to be excessively large and is not suitable for high speed processing. Particularly, such a low $\Delta n$ yarn results in a number of tight spots in the resultant yarn. When a fabric made thereof is dyed, a plurality of dyeing specks may appear on the surface of the finished fabric.

Next, as is well known, the false-twist coefficient $\alpha$ is defined by the equation (3):

$$\alpha = \frac{T \cdot \sqrt{De}}{32{,}500}, \quad (3)$$

where T represents a number of twists (turn/m), and De represents a total denier of the textured yarn to be processed. According to the present invention, to obtain the desirable yarn, the false-twist coefficient $\alpha$ is necessarily within a range from 0.82 to 0.90. If the $\alpha$ is less than 0.82, the crimpability of the textured yarn is considerably lowered down and the finished fabric made of the textured yarn has poor bulkiness, even though it will have a good resiliency, which is not the aimed one. Generally, speaking, the TC becomes larger as the $\alpha$ increases, while, the SV becomes smaller as the $\alpha$ increases. Thus, it is found that the suitable range for $\alpha$, in which the textured yarn has the desirable TC and SV, is from 0.82 to 0.90.

From physical theory, it is clear that the above-mentioned SV can be represented by the following equation (4):

$$SV = \sqrt{\frac{E}{\rho}}, \quad (4)$$

where E is a Young's modulus of a medium and $\rho$ is a density thereof. In case of a filament yarn, E is substantially proportional to an orientation degree of fiber molecules. The orientation degree becomes larger as the draw ratio of the yarn increases. In other words, the SV represents the Young's modulus or the orientation degree of the molecules. The SV can be measured by a method proposed by Church and Morsely in Textile Research Journal, vol. 29, p 525 published in July, 1959. In the present invention, the SV is measured by Vibron V, provided by Toyo Sokki K.K. of Japan.

With a false-twist texturing machine constructed in accordance with the conventional principle stated before, it is impossible to obtain a textured yarn having a larger TC together with a larger SV. That is, in the conventional process, to make the TC larger, one must increase both of the heater temperature and $\alpha$ simultaneously. This, however, results in a decrease of the SV. On the other hand, to make the SV larger, one must lower the heater temperature along with increasing the draw ratio of the yarn or with decreasing value of $\alpha$. This, however, results in a decrease of the TC. Therefore, the desired woven fabric cannot be obtained as long as one relies upon the conventional principle.

The textured yarn of the present invention having both the larger TC and SV can be produced only by a novel DTY process in which the twisted polyester POY delivered from the heater is introduced to a friction type twister while keeping the pre-twister temperature above the Tg of the fiber material, it being preferably within a range between 80° C. and 150° C. This is the most important feature of the present invention. It is against common sense in the conventional DTY process to keep the yarn in a higher pre-twister temperature.

The relations between the pre-twister temperature and both the TC and SV are shown in the graph in FIG. 1. It is apparent from the graph that the SV increases as the pre-twister temperature increases, while the TC reaches its maximum corresponding to the pre-twister temperature of approximately 110° C. and, then, decreases steeply. The TC corresponding to the above preferable range is significantly larger than that usually obtained under the conventional conditions in which the yarn is cooled below the Tg before the false twister. The same is also true regarding the SV.

In this connection, an explanation is now made on the reason why the pre-twister temperature must be above 80° C. Any type of twister has more or less a function to stretch the yarn, which is positive in case of a friction type of twister and is passive in case of a spindle type. The yarn is drawn by this function. Accordingly, if the yarn in the twister is cooled below the Tg thereof, molecules of the filament are hardly movable relative to each other, so the filament may easily be broken due to the stretching force of the false-twister. To prevent such breakage, the pre-twister temperature has to be kept at least above Tg, preferably at approximately 125° C. where $\alpha$ dispersion of the polyester appears. The $\alpha$ dispersion relates to behavior of the molecules in an amorphous region of the fiber (refer to Journal of Polymer Science, vol. 61, issue 171 (1962), S7 to 10). When the pre-twister temperature exceeds 150° C., not only the filament itself but also a macroscopic crimp shape is stretched. As a result, the TC is undesirably decreased.

Since the amorphous region of the filament is well drawn and oriented in the range from 80° C. to 150° C. without destroying the crimp shape, the resultant yarn has a good shrinkability which enhances development of the crimp after the yarn is treated in boiling water.

Contrary to this, if the pre-twister temperature is lower than the lower limit of the range, since the amorphous region of the filament cannot be well drawn, the shrink-ability of the yarn is less than that of the above case, whereby the TC is not so high. One measure of the molecular orientation in the amorphous region is the SV.

A crimp of the false-twist textured yarn in a latent state according to the present invention has a longer wavelength than that of the conventional DTY yarn. In other words, the yarn of the present invention has less number of crimps per unit length.

Various types of apparatus are applicable to carry out the above-mentioned DTY process according to the present invention. The simplest ways to modify the conventional apparatus are, for example, to shorten a cooling plate so as not to lower the temperature of the yarn to a large extent or to provide an additional heater instead of or in cooperation with the cooling plate. However, these are only examples. Of course, other means may be adopted.

Next, an explanation is made on the necessity of simultaneous draw texturing. This is mainly an economic consideration as it allows elimination of steps as compared to the conventional process. In the conventional process, undrawn yarn is separately drawn to a fully drawn yarn by a draw twister, and then the fully drawn yarn is textured by another machine. Further, POY utilized in the DTY process can be produced by high speed spinning. As a result, the textured yarn is obtainable at higher productivity with a low processing cost. To improve productivity, a friction type twister is adopted in the present invention rather than a spindle type. A further advantage of the friction type twister is that it has a positive yarn driving function, whereby the untwisting tension is almost as low as a twisting tension. Contrary to this, a spindle type spinner has no yarn driving function, so the untwisting tension reaches as high as twice the twisting tension. Since the untwisting tension becomes greater as the yarn processing rate increases, the spindle type cannot be utilized.

As to the friction type twister either a disc type or a belt type can be utilized. Of the two, the former is better because of its good yarn driving function.

The polyesters used in the present invention are mainly polyesters, for examples, polyethylene terephthalate (PET), with a basic acid component of an aromatic dicarboxylic acid and a divalent glycolic component of an aliphatic type. However, they may be polyesters with terephthalic acid partially substituted by another difunctional carboxylic acid, such as an aromatic dicarboxylic acid, e.g., isophthalic acid or naphthalene dicarboxylic acid; an alicyclic dicarboxylic acid, e.g., hexahydroterephthalic acid; an aliphatic dicarboxylic acid, e.g., adipic acid or sebacic acid, or an oxy acid, e.g., p-$\beta$-hydroxyethoxybenzoic acid or $\epsilon$-oxycapronic acid, and/or with ethylene glycol partially substituted by another glycol, such as trimethylene glycol or tetramethylene glycol. The polyesters also may be those prepared by copolymerizing one or more multifunctional compounds, such as pentaerythritol, trimethylol propane, trimellitic acid, or trimesic acid or functional derivatives thereof and/or one or more monofunctional compounds, such as O-benzoyl benzoic acid or methoxy polyethylene glycol, or functional derivatives thereof, so as to be substantially linear.

As described above, according to the present invention, the yarn is not cooled in a cooling zone as usual, but is rather positively heated so as not to cool below the Tg and is processed with a relatively smaller number of false-twists. This provides a high quality textured yarn of improved crimpability and, therefor, a resultant fabric rich in bulkiness and resiliency.

The textured yarn according to the first aspect of the present invention can be produced by any of the DTY machines illustrated in FIG. 3 to 7.

Figure 3:
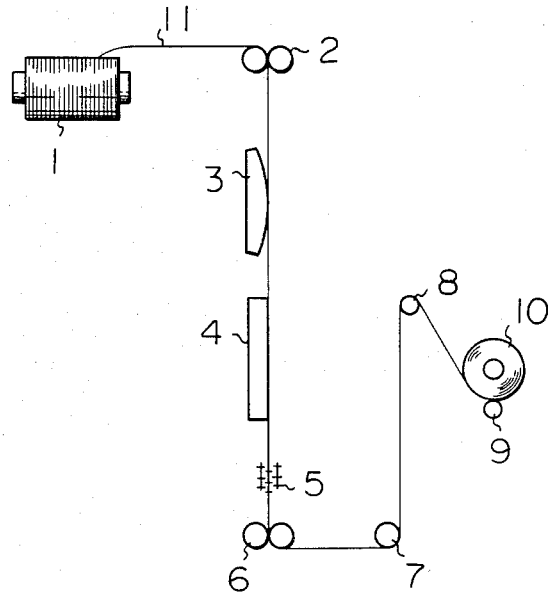
FIG. 3 is a side view of a first embodiment of a DTY machine suitable for carrying out a process according to the present invention.

The first embodiment shown in FIG. 3 is basically identical, in the arrangement of parts, to an ordinary one-heater type DTY machine. In the embodiment, there are arranged, in series, a main heater 3, an additional heater 4, and a friction type false twister 5 between a feed roller 2 and a delivery roller 6. Polyester POY 11 taken out from a package 1 is drawn at a predetermined ratio between the feed roller 2 and the delivery roller 6. Simultaneously with the drawing, the POY 11 is false-twisted by the false twister 5, in which the twisted POY 11 is touched to the main heater 3 and then is introduced to the false twister 5 while the yarn is kept above the Tg by means of the additional heater 4. In the conventional DTY machine, instead of the additional heater 4, a cooling plate is provided for lowering the pre-twister temperature. Thus, the additional heater 4 is a main part of the present invention. The yarn is untwisted and through guides 7, 8, is wound on a surface-drive roller 9 as a textured yarn cheese.

Figure 4:
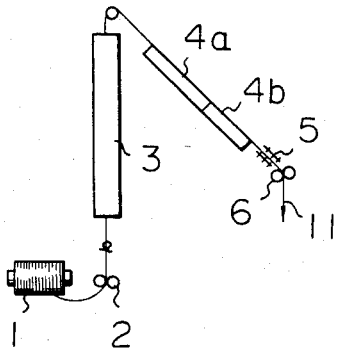
FIGS. 4 through 8 are side views of a second through sixth embodiments, respectively, of the DTY machine.
Figure 5:
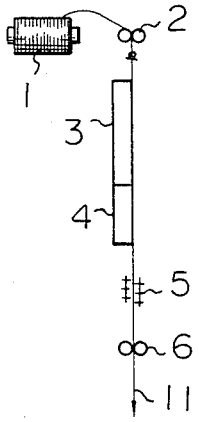

The second and third embodiments shown in FIGS. 4 and 5, respectively, are modifications of the first one. That is, in the second embodiment, the additional heater 4 is divided to a cooling part **4*a* and a heating part 4*b*. In the third embodiment, the additional heater 4 is adjacently disposed to the main heater 3 without any space therebetween. The second embodiment is suitable for processing a thick yarn at a high rate, and the third embodiment is suitable for a thin yarn at a low rate. In the case of the former, since the cooling time is rather short, the yarn is preferably cooled forcibly by the cooling part 4*a* and thereafter heated again by the heating part 4*b***. In the case of the latter, since the cooling time is rather long, the yarn is preferably heated continuously at a lower temperature.

Figure 6:
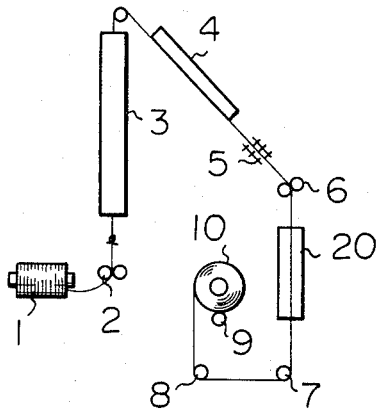

The same idea is applicable also to a double-heater type DTY machine of a fourth embodiment as shown in FIG. 6, in which the additional heater 4 is provided prior to the false twister 5. Generally, the textured yarn delivered from the delivery roller 6 is relaxed by passing through a second heater 20 so as to lower a torque of the yarn.

Figure 7:
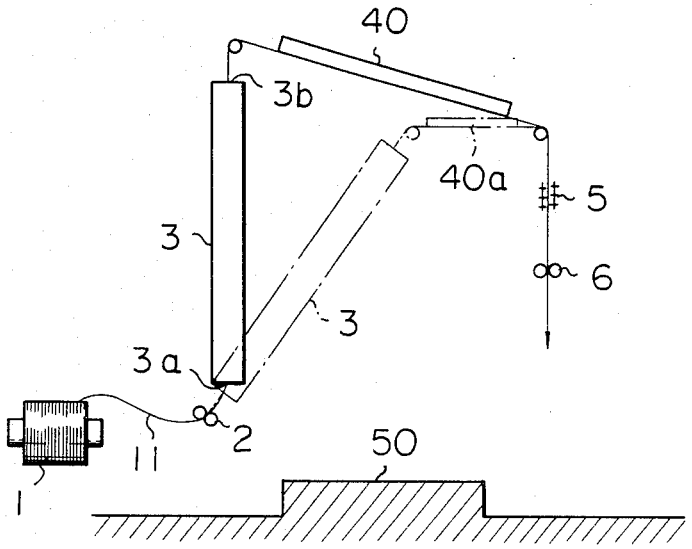

A fifth embodiment shown in FIG. 7 has no additional heater 4 but has an overhead cooling plate 40 above an operator's floor 50 transversely provided in the machine. The main heater 3 of the fifth embodiment is swingably pivoted on a pin provided in the vicinity of an inlet **3*a* thereof. A length between a false twister 5 and an outlet 3*b*, of the main heater 3 is shortened corresponding to an inclination angle of the main heater 3 and the overhead cooling plate 40 is replaceable by another shorter cooling plate 40*a*. According to this embodiment, when the main heater is in a normal position, the yarn is cooled below, the Tg by a sufficiently long cooling plate 40, resulting in a conventional textured yarn. However, when the main heater 3 is in a tilted position as shown by a chain line, the yarn is not so cooled because of the shorter cooling time due to the shorter plate 40*a***, resulting in a novel textured yarn according to the present invention. This type of the DTY machine is very advantageous because a wider range of textured yarn can be obtained by the single DTY machine.

The present invention will be more fully apparent in reference to the following examples.

EXAMPLE 1

POY of 224 De/48f was prepared by melt spinning of polyethylene-terephthalate having an intrinsic viscosity [$\eta$] of 0.64 and containing 0.3% by weight of $TiO_2$ as a delusterant. The spinning rate was 3,400 m/min. The POY was processed by a DTY machine shown in FIG. 3, varying the main heater temperature, the twist coefficient, and the pre-spinner temperature. Thereby, 14 samples were obtained. Then, 14 fabrics were woven utilizing the samples as a weft.

Conditions of DTY machine

Main heater length: 1.5 m
Additional heater length: 2.0 m (plate type)
False twister: belt type, made of neoprene having a hardness of 80 degree
Draw ratio: 1.5
Processing rate: 500 m/min
Space between the first heater and the additional heater: 10 cm
Space between the additional heater and the spinner: 10 cm Conditions of weaving Warp:
polyester filament: 50 d/36 f
density: 42 end/cm
Weft:
respective textured yarn: 150 De/48 f×2 ply
density: 33 end/cm
Weave construction: 4/2 twill The TC and SV of the textured yarns and the width shrinkage of the fabrics when treated in boiling water for 20 sec. were measured as stated before. The results are given in Table 1. In this connection the pre-twister temperature was measured by a yarn thermometer produced by Transmet Inc. of U.S.A.

TABLE 1

| No. | Main heater temp. (°C.) | Additional heater temp. (°C.) | Pre-spinner temp (°C.) | Twist coefficient ($\alpha$) | TC (%) | SV (kg/sec) | Width shrinkage (%) |
|---|---|---|---|---|---|---|---|
| 1* | 230 | 30 | 29 | 0.89 | 23.4 | 2.39 | 19.5 |
| 2* | 230 | 51 | 50 | " | 24.3 | 2.44 | 24.8 |
| 3* | 230 | 72 | 71 | " | 27.2 | 2.47 | 29.9 |
| 4 | 230 | 82 | 81 | " | 29.5 | 2.53 | 33.7 |
| 5 | 230 | 101 | 98 | " | 32.3 | 2.64 | 34.2 |
| 6 | 230 | 122 | 121 | " | 28.5 | 2.73 | 36.5 |
| 7 | 230 | 153 | 149 | " | 26.1 | 2.86 | 35.3 |
| 8* | 230 | 158 | 156 | " | 22.0 | 2.95 | 30.5 |
| 9* | 230 | 78 | 77 | 0.80 | 19.2 | 2.77 | 20.1 |
| 10 | 230 | 83 | 81 | 0.83 | 23.8 | 2.63 | 33.8 |
| 11* | 230 | 80 | 78 | 0.93 | 31.1 | 2.48 | 31.3 |
| 12* | 230 | 158 | 155 | 0.80 | 14.2 | 2.74 | 18.9 |
| 13 | 230 | 149 | 147 | 0.83 | 23.9 | 2.89 | 33.5 |
| 14* | 230 | 159 | 156 | 0.92 | 15.4 | 2.63 | 19.2 |

*blanks

As is apparent from Table 1, all of the textured yarns obtained by the present invention in which the pre-twister temperature is kept within a range from 80° C. to 150° C. have a higher TC value together with a higher SV value, and the fabrics made thereof have a larger width shrinkage.

Moreover, three fabrics of 2/2 twill were woven from the textured yarns of No. 1, No. 6, and No. 7, and were finished as usual. No. 1 is a typical yarn of the conventional process, and No. 6 and No. 7 are of the present invention. After finishing, the three fabrics were subjected to a sensual test of feel. Results of the test showed that No. 1 is poor in both bulkiness and resiliency. Contrary to this, Nos. 6 and 7 were excellent due to their good bulkiness and resiliency.

EXAMPLE 2

The same POY as Example 1 was processed by a DTY machine shown in FIG. 6, a modification of the conventional SDS-8 machine produced by Ernest Scragg of the United Kingdom, varying the main heater temperature, the twist coefficient, and the pre-twister temperature. Six samples were obtained. Then, six fabrics were woven under the same conditions as Example 1.

Conditions of DTY machine

Main heater length: 2.5 m

Additional heater or cooling plate length: 2.55 m

False twister: Three disc type, made of ceramic

Draw ratio: 1.5

Processing rate: 600 m/min

Space between the main heater and the additional heater: 10 cm

Space between the additional heater and the spinner: 15 cm

The same measurement as Example 1 was carried out on the yarns and the fabrics thus obtained. The results thereof are given in Table 2.

TABLE 2

| No. | Main heater temp. (°C.) | Additional heater temp. (°C.) | Pre-spinner temp. (°C.) | Twist coefficient (α) | TC (%) | SV (km/sec) | Width shrinkage (%) |
|---|---|---|---|---|---|---|---|
| 15* | 220 | Cooling plate | 32 | 0.90 | 25.1 | 2.35 | 20.1 |
| 16* | 220 | 76 | 75 | 0.88 | 26.5 | 2.48 | 30.8 |
| 17 | 220 | 84 | 83 | 0.88 | 29.1 | 2.52 | 33.4 |
| 18 | 220 | 123 | 121 | 0.88 | 28.3 | 2.75 | 35.4 |
| 19 | 220 | 151 | 149 | 0.88 | 25.0 | 2.88 | 34.2 |
| 20* | 220 | 155 | 153 | 0.88 | 21.0 | 2.98 | 21.3 |

*blanks

Table 2 gives almost the same conclusions as in Example 1.

A sensual test in two finished 2/2 twill fabrics made of the yarns of No. 15, typical conventional yarn, and No. 17, typical yarn of the present invention, also showed excellence of the present invention.

[Second Aspect]

A second aspect of the invention, a modification of the first aspect is now described.

It is an object of the second aspect of the invention to provide a textured yarn suitable for producing a fabric of good hand and warm appearance like one from natural materials.

Generally speaking, a fabric from a conventional textured yarn has a smooth surface but gives a cold impression to the observer. There is therefore a strong demand for a natural looking fabric made of synthetic filament yarn.

The present inventors studied the matter and found that a textured yarn having a variety of crimp properties along the longitudinal direction is suitable for this purpose.

As described before regarding the first aspect, a grey fabric made from a textured yarn is relaxed in the relaxation process and causes width shrinkage, whereby the hand and appearance of the finished fabric are improved. The width shrinkage mainly relies on the crimpability of the textured yarn. On the other hand, the creping effect of the fabric surface mainly relies on the sonic velocity. Therefore, the desirable quality of the finished fabric may be controllable by the two factors of crimpability (TC) and sonic velocity (SV). According to the second aspect of the invention, the desired textured yarn can be obtained by varying the pre-twister temperature periodically or non-periodically during the DTY processing, whereby crimp unevenness is caused along the longitudinal direction of the resultant yarn. In this connection, it is confirmed by the present inventors that the relationship between the pre-twister temperature and the torque is substantially equivalent to one between the former and the SV as shown in FIG. 1.

That is, the yarn of the second aspect of the invention is a textured yarn of polyester filament having crimp unevenness in the longitudinal direction but having no tight spots, characterized in that the yarn has portions of smaller number of crimps and of larger number of crimps arranged alternately, a torque of the former portion being larger than that of the latter portions. The larger crimp portions and/or the smaller crimp portions have substantially the same crimp properties as the yarn of the first aspect. Accordingly, the second aspect is a modification of the first aspect.

According to the conventional process, crimp unevenness is mainly produced by varying the number of false-twists or processing tension. Such a variation of the factors necessarily is accompanied by fluctuation of the untwisting tension and, therefore, tight spots in the resultant yarn. The tight spots of the textured yarn result in a number of marks like a worm-eaten trace on the fabric made therefrom. This phenomenon is remarkable when a thick-and-thin yarn (an irregularly drawn yarn) is utilized as a starting yarn. Accordingly, the starting yarn of the present invention preferably has a U% of less than 3%.

A process for producing the textured yarn according to the second aspect of the present invention is now explained in more detail referring to the accompanying drawings.

The above-mentioned textured yarn is obtainable by varying a yarn temperature just before being introduced into a false twister, i.e., a pre-twister temperature as designated before. The pre-twister temperature is usually measured at a yarn portion within 5 cm distance from an inlet of the twister.

The process of the second aspect is essentially the same as the process of the first aspect, in which the starting POY of polyester filament is draw-textured by a DTY machine provided with an additional heater between a main heater and a false twister. In the case that the pre-twister temperature is kept constant above a glass transition temperature (Tg) of the yarn by means of the additional heater, the textured yarn of the first aspect can be produced. In the process of the second aspect, an intermittently operable cooling means is further arranged between the additional heater and the false twister. Accordingly, if the cooling means is operated, a yarn having a temperature above Tg is cooled partially along the length thereof, and the unevenness of crimp and/or torque occurs along the longitudinal direction of the resultant textured yarn.

Figure 2:
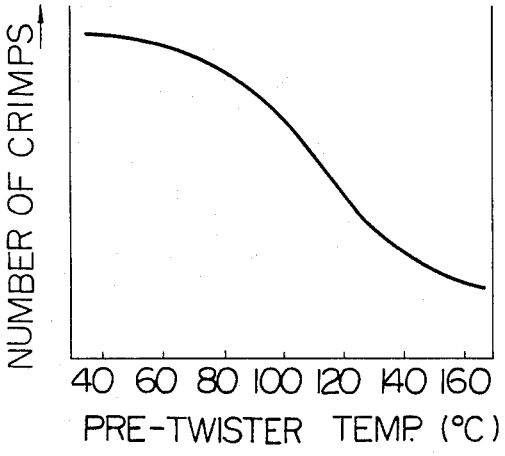
FIG. 2 is a graph of a relation of the pre-twister temperature to the number of crimp of the textured yarn.

This is because the crimp properties such as crimpability (TC), number of crimps (CN), or torque of the textured yarn varies along with the pre-twister temperature as shown in FIGS. 1 and 2.

If the additional heater is adjusted to give a pre-twister temperature P corresponding to the maximum TC (approximately 110° C. according to FIG. 1) and, thereafter, the yarn is cooled intermittently by the cooling means, a textured yarn is produced having crimp unevenness, in which portions of larger and smaller CN are arranged alternately, the former portion having a smaller TC and the latter portion having a larger TC (this type textured yarn is referred to as "a" type hereinafter). While, if the additional heater is adjusted to give a pre-twister temperature above P and, thereafter, the yarn is cooled partially by the cooling means, the textured yarn is produced having unevenness, in which portions of larger and smaller CN are arranged alternately, the former portion having a larger TC and the latter portion having a smaller TC (this type textured yarn is referred to as "b" type hereinafter).

A fabric from the "a" type yarn is rich in bulkiness and shows a gentle creping effect. While, a fabric from the "b" type yarn is rich in resiliency and shows a rough craping effect because of the larger torque in the portion of smaller TC.

Care must be taken not to obstruct running of the yarn when the intermittent cooling is carried out. Such obstruction breaks the balance of the twist in the yarn and causes tight spots in the resultant yarn.

The graph in FIG. 1 can be divided to five zones A, B, C, D, and E. In zone A, curves of the TC and torque are rather flat to the pre-twister temperature. In zone B, the TC and torque increase sharply as the pre-twister temperature increases. In zone C, the TC reaches the maximum, while the torque increases more sharply. In zone D, the TC decreases as the pre-twister temperature increases, while the torque is continuously increasing. In zone E, the TC decreases more sharply and the torque reaches its maximum value. According to the present invention, the above-mentioned tendencies of the TC and torque are well utilized in a yarn. In this connection, the "a" type yarn is obtained by a combination of any pair of the zones A, B, and C, while the "b" type yarn is obtained by a combination of any pair of the zones C, D, and E.

Of course, other conditions of the DTY process such as the type of the twister are substantially the same as those according to the first aspect of the invention. Therefore, the explanation thereof is omitted herein.

Figure 8:
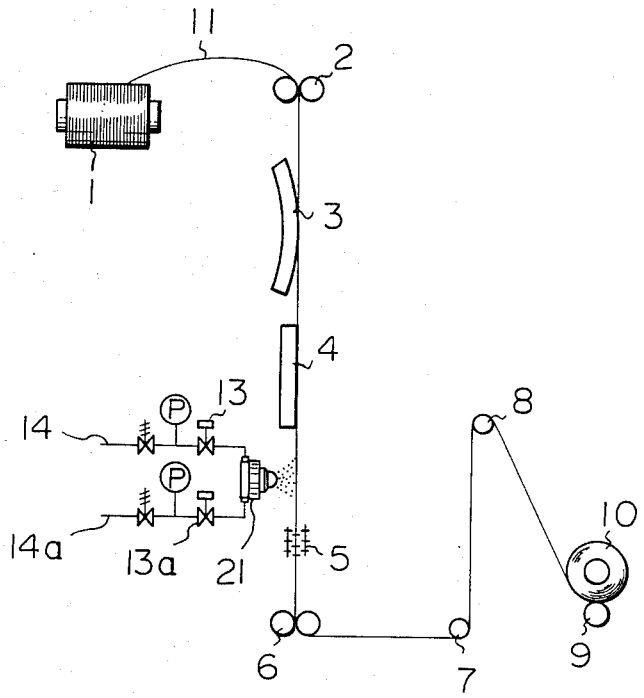

In FIG. 8 is illustrated an embodiment of the apparatus suitable for producing the specific textured yarn according to the second aspect of the invention. This embodiment is an improvement of the one-heater DTY machine shown in FIG. 3. A water spray gun 21 is provided between an additional heater 4 and a false twister 5. The spray gun 21 is connected to a high pressure air pipe 14 and a water pipe 14*a*, which are provided with solenoid valves 13 and 13*a*, respectively. The valves 13 and 13*a* open or shut the pipes 14 and 14*a* in accordance with the action of a timer (not shown) so that a water mist is ejected intermittently from the spray gun 21. A POY of polyester is introduced into a main heater 3 by a feed roller 2. The main heater 3 is adjusted to have a predetermined temperature between 190° C. and 230° C. The yarn delivered from the main heater 3 further contacts the additional heater 4 and, thus, is kept at a pre-twister temperature at least above Tg, preferably at around 125° C. Then, the yarn is intermittently subjected to the water mist from the spray gun 21 for partial cooling before being introduced into the false twister 5. Thereafter, the yarn is untwisted and is drawn by a delivery roller 6. Between the feed roller 2 and the delivery roller 6, the yarn 11 is drawn to a predetermined thickness. Finally, the textured yarn is wound on a cheese 10 driven by a friction roller 9. Depending on the ejecting time period, vacant time period, and amount of water in the spray, unevenness of the crimp and the torque can occur in the yarn along the longitudinal direction. Of course, besides the spray gun, other means, for example, a gear roller, can be utilized for imparting water to the yarn.

The second aspect of the invention will be more fully apparent in reference to the following example.

EXAMPLE 3

Polyester POY of 225 d/48 f was processed by a Scragg-SDS II type DTY machine partially modified, as shown in FIG. 8, to be applicable to the present invention, varying the pre-twister temperature by adjusting the temperature of the additional heater. The machine conditions were as follows:

Draw ratio: 1.5
Processing rate: 200 m/min
Main heater temperature: 220° C.
Number of false twists (at the inlet of the main heater): 2380 t/m ($\alpha$=0.90)
Pre-twister temperature: 60° C., 110° C., 130° C., 160° C.

By combining various spraying periods of water mist with the above-mentioned pre-twister temperatures, 12 samples of the textured yarn were obtained. The yarn properties thereof were measured on TC, CN (number of crimp) and TR (torque). The methods of measurement of the items were as follows:

TC: Same method as described for the first aspect of the invention except for the size of the test piece. In this example, the test piece is a 45 cm hank of single loop instead of a 1500 De hank.

CN: The number of crimps are counted for a single filament of textured yarn of 5 cm length loaded by a weight of 2 mg/De and is converted to a value per 1 inch length. The average for five tests is calculated.

Tr: A single filament of textured yarn of 90 cm length is folded at the center thereof and is loaded thereat by a weight of 10 mg/De for one minute, whereby the yarn is self-twisted due to its torque. Then, the yarn is treated in boiling water for 10 minutes. Thereafter, the number of twists on a 25 cm length of the middle portion of the yarn is measured by a twist counter.

The above measurements were each made on 100 test pieces collected continuously along the textured yarn. The measured values were arranged in order of the test pieces to show the periodic tendency of each item. A higher value group and a lower value group were averaged. The average values are tabulated in columns "mist portion" and "normal portion" in Table 3.

According to Table 3, in samples Nos. 1 to 3, the values of TC, CN, and Tr for both portions are substantially equal to each other, and therefore, are not included in the present invention. This is because the pre-twister temperature is 60° C. at which the TC, CN, and Tr do not vary so steeply relative to the yarn temperature as shown in FIGS. 1 and 2. In samples Nos. 4 to 12, the values of TC, CN, and Tr for both portions have some differences, i.e., the samples have a periodic unevenness of crimp. This is because the pre-twister temperature is above Tg, namely above 80° C. at which an inclination of the curvature of each item relative to the pre-twister temperature is steeper, thereby even a small difference of the pre-twister temperature causes a large difference in the items. Samples Nos. 4 to 6 correspond to a textured yarn of the "a" type as described before, and the sample Nos. 10 to 12 are of the "b" type.

All of the sample Nos. 4 to 12 have portions of less Tr and larger CN and portions of larger Tr and less Tr, alternately. Moreover, they have no tight spots and have U% of less than 3%. Their measured periodicity is very similar to the calculated one.

Though ejection of the water mist was carried out periodically in the example, it is better to adopt random ejection with the acid of a process computer.

TABLE 3

| No. | Pre-spinner temp. (°C.) | Ejecting period (sec.) : Non ejecting period (sec.) | TC (%) Mist portion | TC (%) Normal portion | CN (/2.5 cm) Mist portion | CN (/2.5 cm) Normal portion | Tr (/25 cm) Mist portion | Tr (/25 cm) Normal portion |
|---|---|---|---|---|---|---|---|---|
| 1 | 60 | 1:2 | 24 | 25 | 31 | 30 | 12 | 13 |
| 2 | " | 0.5:2 | 25 | 26 | 30 | 29 | 13 | 14 |
| 3 | " | 0.25:2 | 25 | 26 | 30 | 29 | 12 | 13 |
| 4 | 110 | 1:2 | 26 | 31 | 29 | 21 | 15 | 21 |
| 5 | " | 0.5:2 | 27 | 32 | 29 | 21 | 16 | 22 |
| 6 | " | 0.25:2 | 27 | 32 | 30 | 21 | 16 | 21 |
| 7 | 130 | 1:2 | 26 | 29 | 27 | 17 | 18 | 25 |
| 8 | " | 0.5:2 | 27 | 28 | 28 | 16 | 19 | 24 |
| 9 | " | 0.25:2 | 28 | 29 | 28 | 17 | 19 | 24 |
| 10 | 160 | 1:2 | 29 | 23 | 22 | 13 | 19 | 26 |
| 11 | " | 0.5:2 | 28 | 22 | 22 | 14 | 20 | 26 |
| 12 | " | 0.25:2 | 29 | 22 | 22 | 13 | 20 | 25 |

We claim:

1. A method for producing a textured yarn suitable for weaving a fabric having an improved width shrinkage, in which a partially oriented yarn of polyester filament is textured by false-twisting simultaneously with drawing by a draw-texturing machine which comprises a main heater, an additional heater and a false twister arranged in series between a feed roller and a delivery roller, said additional heater being maintained at a temperature lower than the temperature of the main heater and said false-twister being of a friction type having a yarn driving function, said method being characterized in that, said yarn is delivered through a yarn path from said main heater to said false twister through said additional heater, so that said yarn has a yarn temperature above 80° C. at the moment of introduction into said false twister.

2. A method according to claim 1, in which said yarn temperature is maintained within a range between 80° C. and 150° C.

3. A method according to claim 1, in which said false-twisting is carried out with a number of twists corresponding to a twist coefficient defined below:

$$0.82 \leqq \alpha \leqq 0.90,$$

where $\alpha$ is expressed by the following equation, $$\alpha = \frac{T \cdot \sqrt{De}}{32{,}500},$$

where T represents a number of twists (turn/m), and De represents a total denier of said textured yarn.

4. An in-draw false twist texturing machine comprising a feed roller, a main heater for setting a twisted configuration of a thermoplastic filament yarn being processed, a friction type false twister, and a delivery roller, all of which are arranged in series along a yarn path, characterized in that an additional heater maintained at a temperature lower than the temperature of the main heater is provided, instead of a cooling means, between said main heater and said false twister, for maintaining the yarn temperature above 80° C. at introduction to said false twister.

5. A false twist-texturing machine according to claim 4, in which said feed roller is rotatable at a lower surface speed than that of said delivery roller, whereby drawing of said yarn can be carried out simultaneously with false-twisting.

6. A false-twist texturing machine according to claim 4, in which said false twister is of a friction type having a yarn driving function.

7. A false-twist texturing machine comprising a feed roller, a main heater, a cooling means, a false twister, and a delivery roller, all of which are arranged in series along a yarn path, said main heater and said false twister being disposed oppositely straddling an operator's floor so that said cooling means is mounted above said operator's floor in an overhead manner, said texturing machine being characterized in that said main heater is swingably pivoted to a fixed portion in the vicinity of an inlet portion thereof, whereby a distance between an outlet of said main heater and said false twister is adjustable, and said cooling means is replaceable corresponding to said distance.

8. A method for producing a textured yarn suitable for weaving a fabric having an improved width shrinkage, in which a partially oriented yarn of polyester filament is textured by false-twisting simultaneously with drawing by a draw-texturing machine which comprises a main heater and a false twister arranged between a feed roller and a delivery roller, said method being characterized in that, after said yarn is delivered from said main heater, said yarn is maintained at a yarn temperature of 120° C.±40° C. and then is forcibly cooled intermittently before introduction into said false twister, whereby unevenness of crimp occurs in the longitudinal direction.

9. A method according to claim 8, in which said cooling is carried out by a water mist ejected from a spray gun.

10. A false-twist texturing machine according to claim 4, further comprising a force cooling means intermittently operable to said yarn provided between said main heater and said spinner.

11. A false-twist texturing machine according to claim 10, in which said false twister is of a friction type having a yarn driving function.

12. A false-twist texturing machine according to claim 10, in which said force cooling means is a water spray gun connected to a water pipe and an air pipe, each provided with a solenoid valve cooperatively connected to a timer.

* * * * *